US009957742B2

(12) United States Patent
Zimmer et al.

(10) Patent No.: US 9,957,742 B2
(45) Date of Patent: May 1, 2018

(54) TOP GUIDE FITTING FOR A SLIDING DOOR

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 0 days. days.

(21) Appl. No.: 15/072,073

(22) Filed: Jun. 9, 2016

(65) Prior Publication Data

US 2016/0340953 A1 Nov. 24, 2016

(51) Int. Cl.
*E05D 15/06* (2006.01)
*E06B 3/46* (2006.01)

(52) U.S. Cl.
CPC ..... *E05D 15/0652* (2013.01); *E05D 15/063* (2013.01); *E06B 3/4636* (2013.01); *E05Y 2201/21* (2013.01); *E05Y 2201/64* (2013.01); *E05Y 2201/692* (2013.01); *E05Y 2600/46* (2013.01); *E05Y 2900/132* (2013.01)

(58) Field of Classification Search
CPC ..... E05D 15/0652; E06B 3/4636
USPC ..... 49/339, 340, 344, 346, 425, 404, 414, 49/415, 416, 419, 420, 421, 423, 436, 49/437, 438, 439
See application file for complete search history.

(56) References Cited

U.S. PATENT DOCUMENTS 2,650,387 A * 9/1953 Foss ..... E05D 15/0691 16/91
2,668,317 A * 2/1954 Le Bon, III ..... E05D 15/0691 16/91
2,971,228 A * 2/1961 Szabo ..... E06B 3/4609 49/209
3,798,839 A * 3/1974 Kaufman ..... E05D 15/0613 160/199
4,064,590 A * 12/1977 Smith ..... E05D 15/264 16/90
4,722,150 A * 2/1988 Jacobs ..... E05D 15/0665 16/91
5,349,783 A * 9/1994 Jasperson ..... E05D 15/0691 16/105
5,974,738 A * 11/1999 Jacobs ..... E05D 15/0691 16/95 R
6,449,906 B1 * 9/2002 Jacobs ..... E05D 15/0691 49/409
6,912,812 B2 * 7/2005 Inage ..... E05D 15/063 16/87 R
7,374,260 B2 5/2008 Lu
7,703,242 B2 * 4/2010 Goebel ..... E05D 15/0621 16/102

(Continued)

FOREIGN PATENT DOCUMENTS

CN 000203 145 671 U 8/2013

*Primary Examiner* — Jerry E Redman
(74) *Attorney, Agent, or Firm* — Klaus Bach

(57) ABSTRACT

In an upper door fitting of a sliding door which comprises a housing and two transverse guide rollers which each are rotatably supported each on a shaft stub, both shaft stubs extend parallel to each other and are arranged symmetrically with respect to a vertical longitudinal center plane. Both shaft stubs are rigidly mounted in the housing. In addition, the transverse guide rollers delimit an intake opening of the housing for guiding the sliding door so as to prevent impact noises and jerky movements of the sliding door.

7 Claims, 4 Drawing Sheets

(56) References Cited

U.S. PATENT DOCUMENTS

| | | | | |
|---|---|---|---|---|
| 8,443,551 | B2 * | 5/2013 | Walhorn | E05F 1/16 16/71 |
| 8,726,574 | B2 * | 5/2014 | Iwaki | E05F 1/16 16/49 |
| 8,733,023 | B2 * | 5/2014 | Rahardjo | B66B 13/08 16/91 |
| 2005/0000164 | A1 * | 1/2005 | Jacobs | E05D 15/0669 49/425 |
| 2007/0017157 | A1 * | 1/2007 | Ambrozus | E05D 15/0669 49/425 |
| 2007/0186481 | A1 * | 8/2007 | Tomita | E05F 1/16 49/409 |
| 2010/0043172 | A1 * | 2/2010 | Nezu | E05B 65/0858 16/71 |
| 2010/0293859 | A1 * | 11/2010 | Nezu | E05B 65/0858 49/358 |
| 2016/0281407 | A1 * | 9/2016 | Zimmer | E05F 5/003 |

* cited by examiner

A-A

TOP GUIDE FITTING FOR A SLIDING DOOR

BACKGROUND OF THE INVENTION

The invention concerns a top door fitting of a sliding door, door fitting comprises a housing and two transverse guide rollers each of which is rotatably supported on a shaft stub wherein both shaft stubs extend parallel to one another and are arranged symmetrically with respect to a vertical longitudinal center plane of the door fitting.

CN 203 145 671 V discloses such door fittings. If there is some play however between the door fitting and a door guide track impact noises or jerky motions of the sliding door may occur.

It is the object of the present invention to develop a door fitting which prevents impact noises and jerky motions of the sliding door.

SUMMARY OF THE INVENTION

The door fitting according to the invention comprises a housing in an upper door fitting of a sliding door which comprises a housing and two transverse guide rollers which each are rotatably supported each on a shaft stub, both shaft stubs extend parallel to each other and are arranged symmetrically with respect to a vertical longitudinal center plane. Both shaft stubs are rigidly mounted in the housing. In addition, the transverse guide rollers delimit an intake opening of the housing for guiding the sliding door so as to prevent impact noises and jerky movements of the sliding door.

The invention will become more readily apparent from the following description with reference to schematically shown exemplary embodiments.

BRIEF DESCRIPTION OF THE DRAWINGS

It is shown in.

DESCRIPTION OF EXEMPLARY EMBODIMENTS

Figure 1:
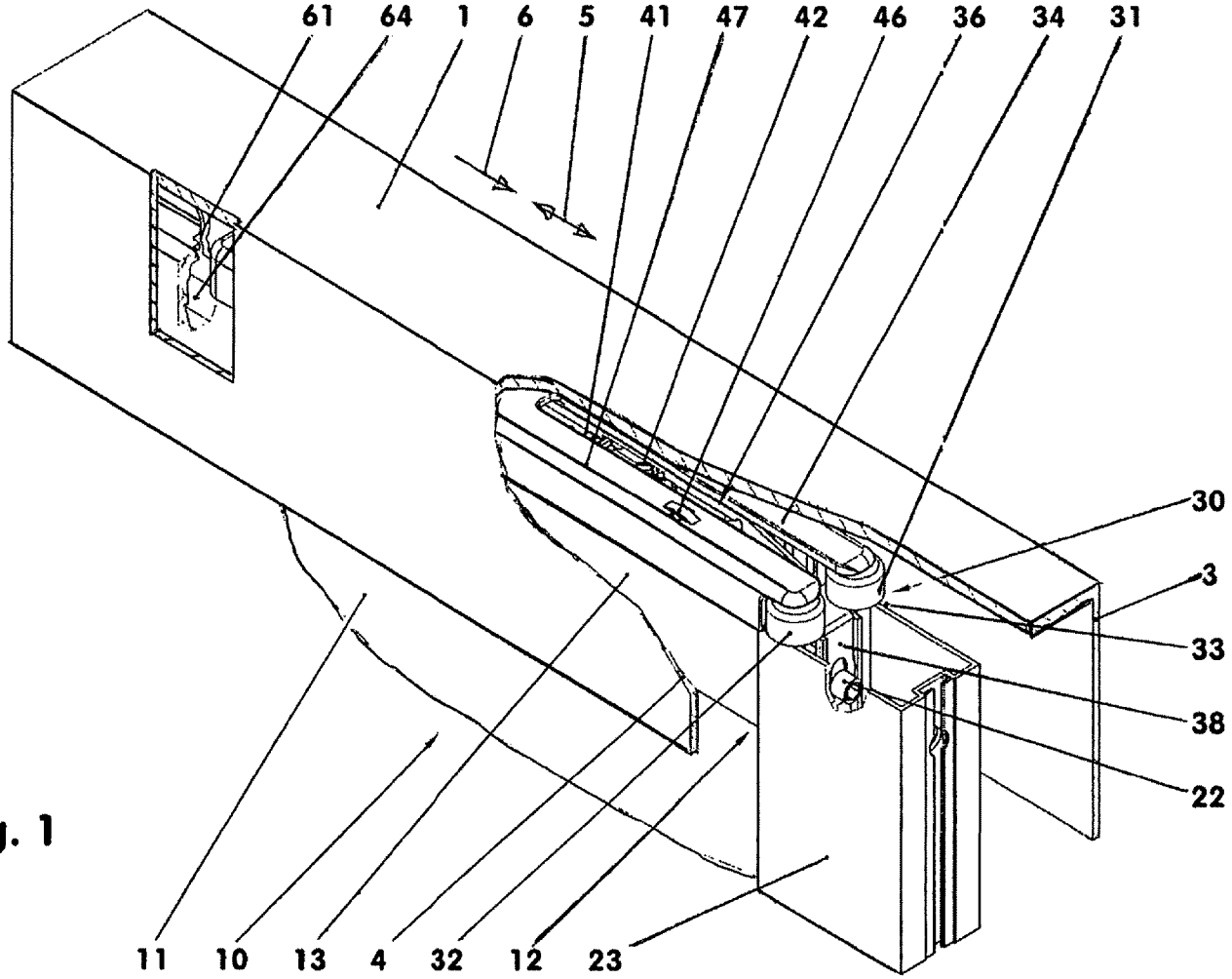
FIG. 1: an isometric view of a top guide of a sliding door.
Figure 2:
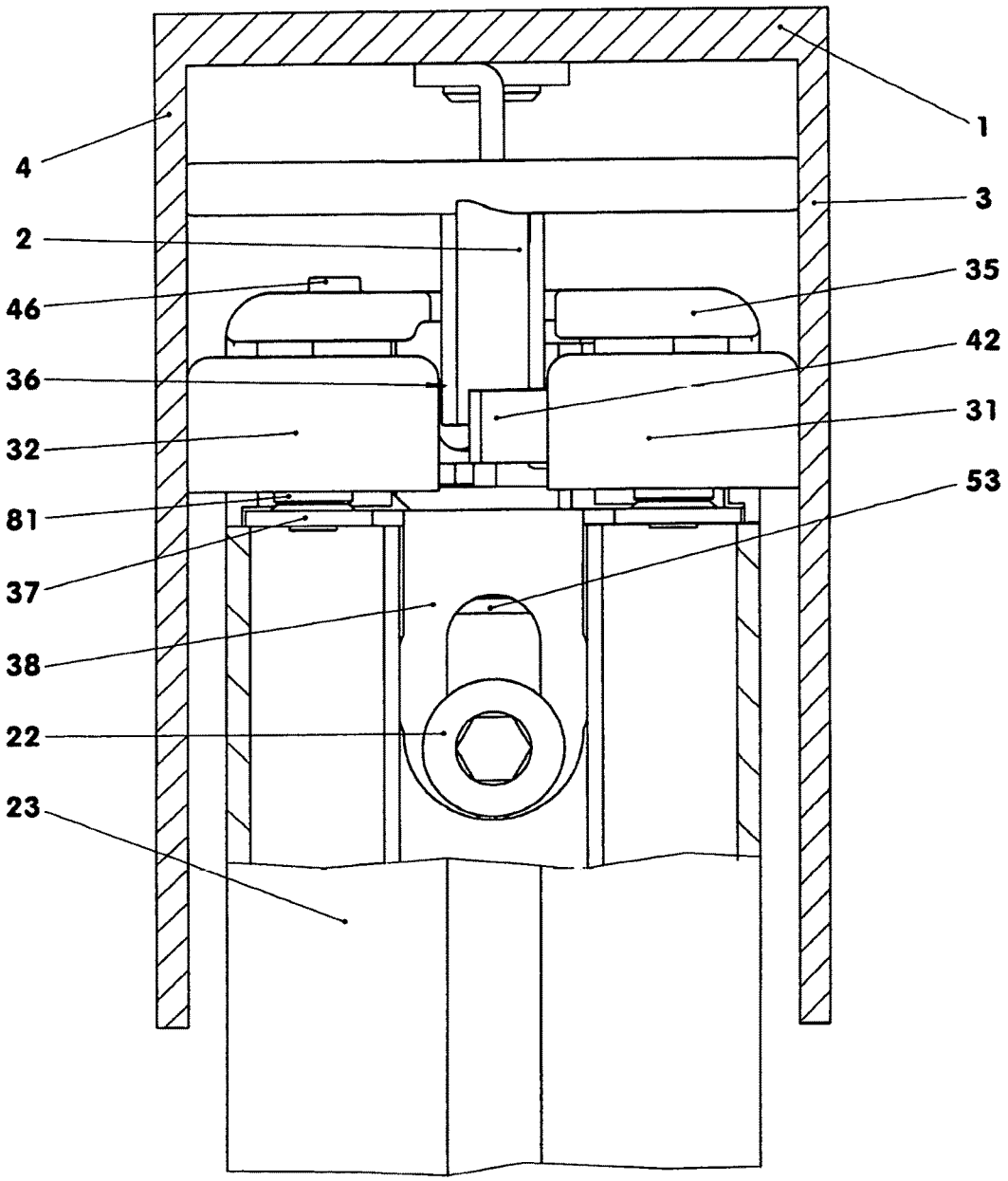
FIG. 2: a front view of the top guide of a sliding door.

FIGS. 1 and 2 show the top guide structure of a sliding door 10. The sliding door 10 is accommodated in a U-shaped door guide track 1. Along this door guide track 1, the sliding door 16 is movable between an open and a closed position. The sliding door can be operated manually or by a motor drive.

The sliding door 10 comprises a multi-part support frame 12 with a sliding door panel 11 disposed therein. On the support frame 12, a door fitting 30 is arranged which, in the longitudinal direction 5, is fixed to the support frame 12 at its two ends. By means of the door fitting 30, the sliding door 10 is guided in the door guide track 1. For the guidance of the sliding door 10, a second door fitting 30 of for example identical design may be arranged at, in longitudinal direction 5, the oppositely oriented end of the sliding door 10. At the bottom end of the sliding door for example support rollers may be arranged.

In the exemplary embodiment, the support frame 12 comprises a horizontal profile element 13 and a vertical profile element 23 connected to the horizontal profile element 13. The vertical element 23 delimits herein the front side of the sliding door 10. In FIG. 1, the vertical frame element 23 is shown which, in the closing direction 6, is the vertical front profile element 23.

The door fitting 30 comprises for its attachment to the door frame a stop plate 38 and a holding element 61. The stop plate 38 projects at the, in-closing direction 6, front end 33 of the door fitting 30 downwardly from the bottom plate 37 of the door fitting 30. By means of a mounting screw 22, the stop plate 38 is screwed to the vertical frame element 23 and the horizontal frame element 13.

The holding element 61 is arranged on the back end of the door fitting 30 opposite the front end 33. In the exemplary embodiment, the holding element 61 is placed onto an angled piece 53 projecting from the back side of the door fitting 30. The holding element 61 may also be arranged for example spaced from the angled piece 53, connected to the door fitting 30. The holding element 61 comprises two clamping legs 64 by which it is held in the horizontal profile element 13 in a force- and/or form-locking manner. The door fitting 30 is in this way firmly disposed on the support frame 12.

Figure 3:
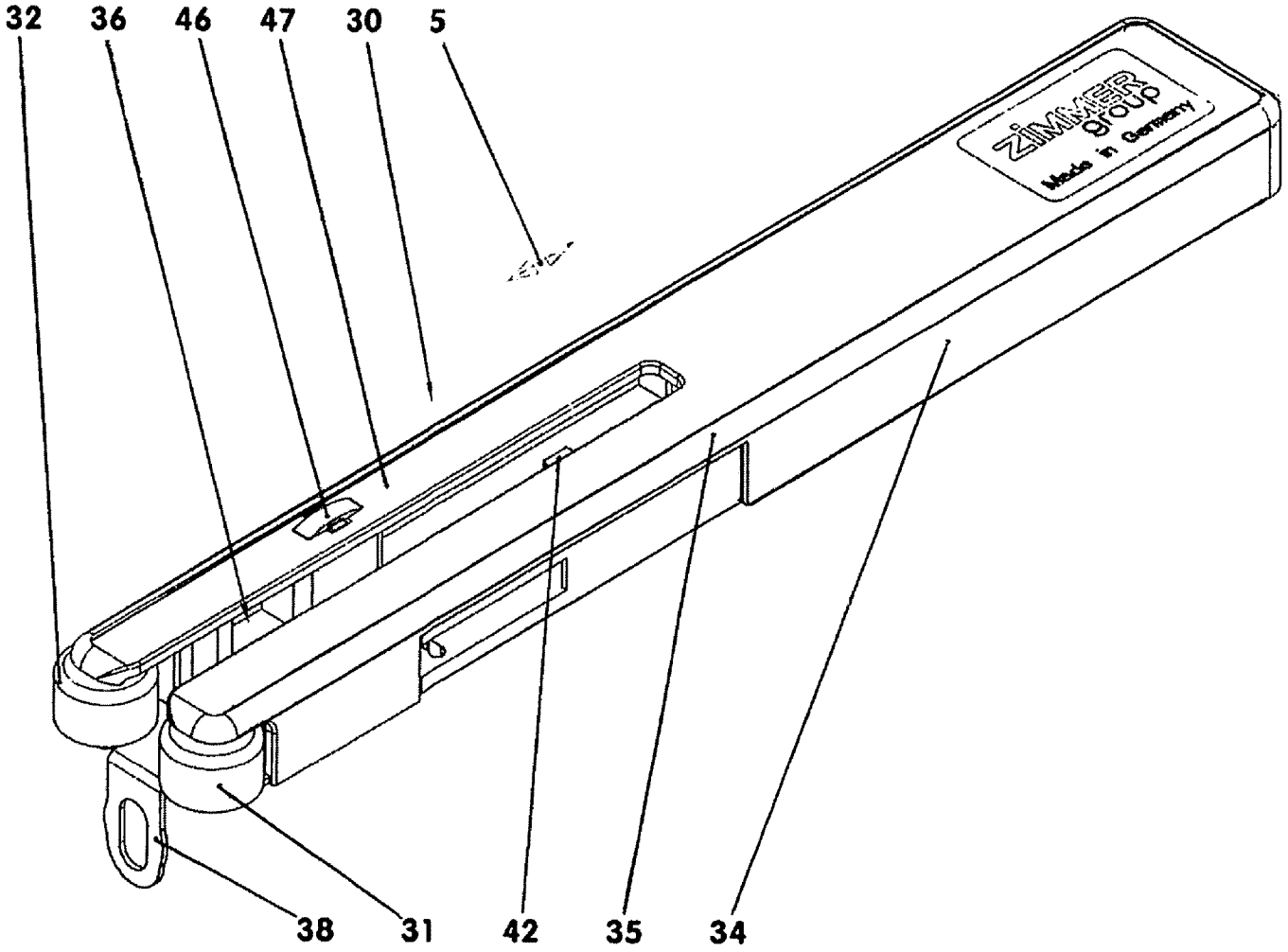
FIG. 3: a door fitting.

FIG. 3 shows a door fitting 30. The door fitting 30 comprises a housing 34. This housing 34 has a lower bottom plate 37 to which a housing lid 35 is attached. In the exemplary embodiment, the bottom plate 37 consists of a metallic material. The housing lid 35 consists for example of a thermoplastic or a duro-plastic material. But it is also possible to manufacture the bottom plate 37 and the housing lid 35 of the same material. A slide shoe 46 on the top side 47 of the door fitting 30 limits a pivoting of the sliding door 10 for example during a rapid brake-down.

In the housing 34, an acceleration and deceleration device 41 is arranged. This device comprises a carrier element 42 which is movable between a force- and/or form-locking park position and an end position. For example, during closing of the sliding door 10, a carrier 2 which is arranged in the door guide track 1 comes into contact with the carrier element 42 and is engaged therewith. The carrier element 42 is released thereby from the park position. As a result, the carrier element 42 is pulled toward the rest position by means of an acceleration arrangement, for example a spring energy store which is de-tensioned, and at the same time braked down by a deceleration arrangement. The deceleration arrangement comprises for example a cylinder-piston unit. The resulting force of the acceleration arrangement and the deceleration arrangement acts on the carrier element 42. The sliding door is moved to for example the closed end position in a controlled manner and comes to a standstill without any impact.

The door fixture 30 has at its front end 33 an accommodation passage 36 which extends parallel to the longitudinal direction 5. This accommodation passage 36 is arranged in the housing lid 35 and extends over the whole path of movement of the carrier element 42. In this accommodation passage 36, the carrier element 42 contacts the carrier 2 which projects into the accommodation passage 36.

At the outer edges of the front side 33 of the housing 34, two transverse guide rollers 31, 32 are rotatably supported. The transverse guide rollers 31, 32 are arranged symmetrically with respect to a vertical longitudinal center plane of the door fitting 30. The axis of rotation of the transverse guide rollers 31, 32 extends normal to the longitudinal direction 5 and parallel to the vertical longitudinal center plane. The cylindrical transverse guide rollers 31, 32 extend sidewardly for example by 15% of their diameter beyond the enveloping contour of the housing 34. In this way, they project by more than 10% of their diameter from the housing 34 so that a collision of the longitudinal webs 3, 4 of the door guide track with the housing 34 is prevented. The internal width of the door guide track 1 which is delimited by the longitudinal webs 3, 4 corresponds for example to the standard width of the door fitting 30 as measured over the transverse guide rollers 31, 32. In the operational state, the door fitting 30 rolls for example with the transverse guide rollers 31, 32 along the longitudinal webs 3, 4.

In the exemplary embodiment, the transverse guide rollers 31, 32 project also at the front end 33 from the housing 34. In this direction, the projection is for example 15% of the diameter of a transverse guide roller 31, 32.

Figure 4:
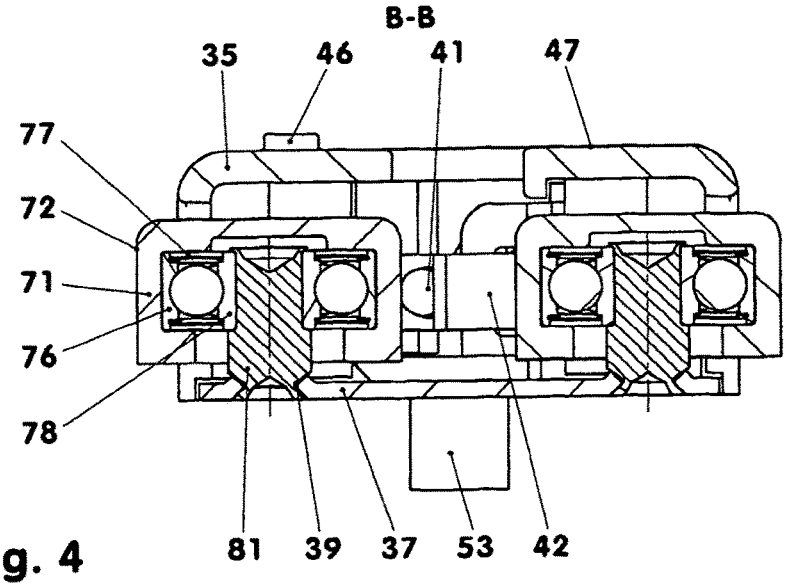
FIG. 4: a cross-section of the door fitting of FIG. 3.

In FIG. 4, the door fitting 30 is shown in a cross-sectional view wherein the cross-sectional plane extends normal to the vertical longitudinal center plane of the door fitting 30 and the transverse guide rollers 31, 32 and through the center of the transverse guide rollers 31, 32. The two identical transverse guide rollers 31, 32 are for example cylindrical. They are provided each with a tire-like rubber sleeve 71 which extends around the outer ring 76 of an anti-friction bearing 77 in a form-fitting manner. Hereby the transverse center plane of the non-friction bearing 77 extends centrally through the running surface 72 of the rubber sleeve 71. The rubber sleeve 71, which in the exemplary embodiment is pot-shaped, is closed at its top side. It extends around the outer ring 76 of the anti-friction bearing 77 with 20% of its height. The outer diameter of the rubber sleeve 71 as measured over the running surface 72 is 23% larger than the outer diameter of anti-friction bearing 77.

In the exemplary embodiment, the bearing 77 is a single row ball bearing which is sealed at both sides and lubricated for life. Its outer diameter in this example is 3.25 times its inner diameter. The height of the friction bearing 77 which is arranged transverse to the vertical longitudinal center plane of the door fitting 30, is 25% greater than its inner diameter. Also, antifriction bearings 77 of different design or even the use of friction bearings is possible.

The individual antifriction bearing 77 is supported with its inner ring 78 on a shaft stub 81. This shaft stub 81 is mounted in the bottom plate 37 of the door fitting 30 and projects therefrom. That is, it is firmly supported on the housing 24 of the door fitting 30.

Figure 5:
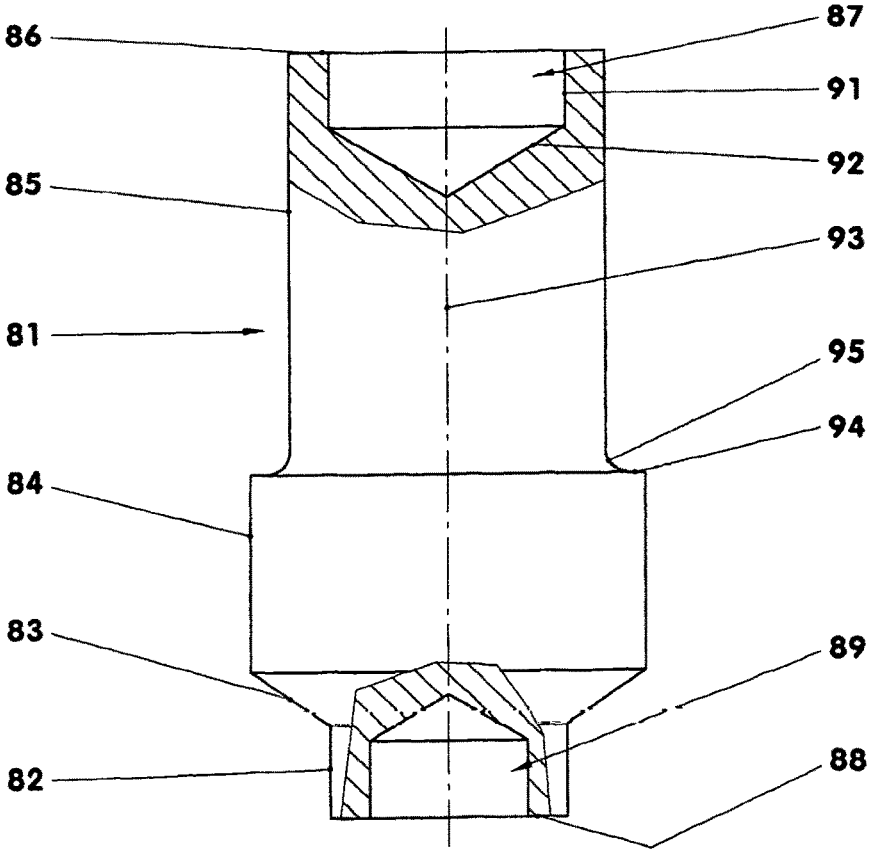
FIG. 5: a shaft stub before the installation.

FIG. 5 shows a shaft stub 81 before its installation in the door fitting. The shaft stub 81 which may consist for example of a metallic material is a shaft component with four coaxial sections 82-85 of different diameters. Its two front sides 86, 88 have central recesses 87, 89. These recesses 88, 89 have in the representation of FIG. 5 in each case a cylindrical recess section 91 and a cone-like recess base 92. The wall thickness of the shaft stub 81 adjacent the cylindrical recess section 91 is smaller than 20% of the outer diameter of the shaft stub 81 in the area of the respective recess 87, 89. The length of the shaft stub 81 is twice its diameter.

The lowermost section 82 of the shaft stub 81 shown in FIG. 5 is a shaft insert section 82. Its diameter is for example three quarts of the diameter of the uppermost section 85 which, below will be called bearing support section 85. The length of the shaft insert section 82 is for example ⅛ of the overall length of the shaft stub 81. Above the shaft insert section 82, the shaft diameter increases in a conical section 83 to an outer diameter of the shaft stub 81. This is also the outer diameter of the shaft support section 84 which is arranged adjacent the conical insert section 83. It is larger, by 25% than the diameter of the bearing support section 85. The shaft support section 84 has an axial support surface 94 which extends normal to the longitudinal axis 93 of the shaft stub 81. The support surface 94 transitions, via a transition groove 95, into the bearing support section 85. The length of the bearing support section 85 is for example 55% of the length of the shaft stub 81. The diameter of the bearing support section 85 is in the exemplary embodiment four millimeters.

During installation the shaft stubs 81 are inserted with the shaft insert section 82 into openings 39 of the bottom plate 37. From the bottom side, the bottom end recesses 89 are then expanded by a punching tool so that the recess wall extend outwardly, see FIG. 4. The shaft stubs 81 are then firmly fixed in the bottom plate 37 of the door fitting 30. Onto the bearing support section 85 of the shaft stubs 81 then in each case an antifriction bearing 77 is pushed. After installation of the bearings, the respective inner ring 78 of the antifriction bearing 72 is seated with a press-fit or a transition fit on the bearing support section 85. The inner ring 78 abuts in each case the support surface 95. For securing the antifriction bearing 77, the upper top recess 87 of the shaft stub 81 is widened for example by means of a punching tool, so that the inner ring 78 is firmly engaged in the direction of the longitudinal axis 93 of the shaft stub 81. Subsequently, the elastically deformable rubber sleeve 71 is placed over the outer ring 76 of the antifriction bearing 77. The two transverse guide rollers 31, 32 are now arranged at a constant distance from each other.

After the installation of the acceleration and deceleration device 41 into the door fitting 30, the housing lid 35 can be put in place and fixed to the bottom plate 37 for example by mounting elements. The housing lid 35 extends over a partial area of the transverse guide rollers 31, 32. It is spaced therefrom and is not in contact with the shaft stub 81. Also, another mounting order is possible.

During opening and closing of the sliding door 10, with ideal adjustment, the two guide rollers 31, 32 roll along the whole suitable length of the longitudinal webs 3, 4 of the door guide track 1. With some clearance between the door guide track 1 and the door fitting 30 with the guide rollers 31, 32, there may be for example only one guide roller 31-32 rolling along one of the longitudinal webs 3, 4. The other guide roller 32, 31 stands still. When the sliding door 10 closes in on its end position, the carrier 2 contacts first the still-standing transverse guide roller 32, 31. The transverse guide rollers 31, 32 roll along the carrier 2 whereby the sliding door 10 is being centered in the door guide track 1. Upon further movement, the carrier 2 moves into the accommodation passage 36 of the housing 34. Here, the carrier element 42 comes into contact with the carrier 2. As described above the carrier 2 releases the carrier element 42 from its locked park position and, coupled to the carrier element 42, is moved with the carrier element 42 to the end position.

If the sliding door 10 and/or the door guide track 1 are in the longitudinal direction bent or wavy, the door fitting 30, for example, together with a second door fitting 30 disposed at the other end of the door, provides for a jerk- or impact-free guiding of the sliding door 10. Herein for example alternately the, in movement direction, right and the left transverse guide roller 31, 32 may abut a longitudinal web 34 or both transverse guide rollers 31, 32 may roll along the two opposite longitudinal web 34. Upon approaching the end position, the stationary carrier 2 centers the sliding door 10 also in this case, so that it moves into the closed end position without any transverse impact.

Also other combinations of the various exemplary embodiments are possible.

REFERENCE NUMBERS

| | |
|---|---|
| 1 | Door guide track |
| 2 | Carrier |
| 3 | Longitudinal web |
| 4 | Longitudinal web |
| 5 | Longitudinal direction |
| 6 | Closing direction |
| 10 | Sliding door |
| 11 | Door panel |
| 12 | Support frame |
| 13 | Horizontal profile element |
| 22 | Mounting screw |
| 23 | Vertical profile element |
| 30 | Door fitting |
| 31 | Transverse guide roller |
| 32 | Transverse guide roller |
| 33 | Front end |
| 34 | Housing |
| 35 | Housing lid |
| 36 | accomodation passage |
| 37 | Bottom plate |
| 38 | Stop plate |
| 39 | Openings |
| 41 | Acceleration and deceleration device |
| 42 | Carrier element |
| 46 | Slide shoe |
| 47 | Top side |
| 53 | Angled piece |
| 61 | Holding element |
| 64 | Clamping leg |
| 71 | Roller sleeve |
| 72 | Running surface |
| 76 | Outer ring |
| 77 | Anti-friction bearing |
| 78 | Inner ring |
| 81 | Shaft stub |
| 82 | Shaft insert section |
| 83 | Conical shaft section |
| 84 | Shaft support section |
| 85 | Bearing support section |
| 86 | Front side top |
| 87 | Recess top |
| 88 | Front side bottom |
| 89 | Recess bottom |
| 91 | Recess section |
| 92 | Recess base |
| 93 | Longitudinal axes of (81) |
| 94 | Support surface |
| 95 | Transition groove |

What is claimed is:

1. An upper door fitting (30) for a sliding door (10) movably guided between opposite spaced longitudinal webs (3, 4) of a door guide track (1) of the sliding door (10), the door fitting (30) comprising a housing (34) and two transverse guide rollers (31, 32) which are rotatably supported each on a shaft stub (81) at one end thereof in a cantilevered fashion so as to extend parallel to each other in spaced relationship and symmetrically with respect to a vertical longitudinal center plane of the door fitting (30), wherein both shaft stubs (81) are rigidly supported in the housing (34) of the upper door fitting (30) in spaced relationship with clearance between the longitudinal webs (3, 4) of the door guide track (1) and the transverse guide rollers (31, 32) so that, with the sliding door (10) fitted within the longitudinal webs (3, 4) of the door guide track (1), not both transverse guide rollers (31, 32) are in constant contact with the longitudinal webs (3, 4) of the door guide track (1), and the two transverse guide rollers (31, 32) which are spaced from each other extend outwardly beyond the housing (34) and inwardly beyond an accommodation passage (36) formed in the housing (34) for accommodating between the two transverse guide rollers (31, 32) a carrier (2) guiding the sliding door (10) to a rest or end position centrally within the longitudinal webs (3, 4).

2. The upper door fitting (30) according to claim 1, wherein the transverse guide rollers (31, 32) are supported to the shaft stubs (81) by antifriction bearings (77) which are sealed at opposite sides.

3. The upper door fitting (30) according to claim 1, wherein the housing (34) extends over free ends of the shaft stubs (8).

4. The upper door fitting (30) according to claim 1, wherein the transverse guide rollers (31, 32) project from the housing (34) in a direction normal to the longitudinal center axis by at least 10% of the diameter of the transverse guide rollers (31, 32).

5. The upper door fitting (30) according to claim 1, wherein the transverse guide rollers (31, 32) project beyond the housing (34) in the longitudinal direction (5) of the door fitting.

6. The upper door fitting (30) according to claim 1, wherein the door fitting (30) comprises a carrier element (42) for being contacted by, and coupled to, the carrier (2).

7. A sliding door (10) with an upper door fitting (30) according to claim 1 installed on the sliding door (10) for guiding the sliding door (10) and controlling movement of the sliding door (10) in the door guide track (1).

* * * * *